US012650260B2

(12) United States Patent
Cutler et al.

(10) Patent No.: US 12,650,260 B2
(45) Date of Patent: Jun. 9, 2026

(54) CRYOGENIC REMOVAL OF CARBON DIOXIDE FROM THE ATMOSPHERE

(71) Applicant: MICROSOFT TECHNOLOGY LICENSING, LLC, Redmond, WA (US)

(72) Inventors: Benjamin Franklin Cutler, Redmond, WA (US); Ruslan Nagimov, Redmond, WA (US); Eric Clarence Peterson, Woodinville, WA (US)

(73) Assignee: MICROSOFT TECHNOLOGY LICENSING, LLC, Redmond, WA (US)

( * ) Notice: Subject to any disclaimer, the term of this patent is extended or adjusted under 35 U.S.C. 154(b) by 396 days.

(21) Appl. No.: 17/828,692

(22) Filed: May 31, 2022

(65) Prior Publication Data

US 2023/0314070 A1 Oct. 5, 2023

Related U.S. Application Data

(60) Provisional application No. 63/325,552, filed on Mar. 30, 2022.

(51) Int. Cl.
*F25J 3/06* (2006.01)

(52) U.S. Cl.
CPC ..... *F25J 3/067* (2013.01); *F25J 2210/40* (2013.01); *F25J 2215/80* (2013.01)

(58) Field of Classification Search
CPC .. F25J 2210/80; F25J 2210/40; F25J 2215/80; B01D 53/002; F24F 2110/12; F24F 2110/70
See application file for complete search history.

(56) References Cited

U.S. PATENT DOCUMENTS 5,592,059 A * 1/1997 Archer ..... F24F 11/871 388/934
7,992,409 B1 8/2011 Cooper
(Continued)

FOREIGN PATENT DOCUMENTS

CH 717568 A2 12/2021
DE 19739473 A1 3/1999
FR 2964390 B1 9/2012

OTHER PUBLICATIONS

"Carbon Dioxide Removal Primer", Retrieved from: https://web.archive.org/web/20220408152659/https:/cdrprimer.org/, Apr. 8, 2022, 1 Page.

(Continued)

*Primary Examiner* — Frantz F Jules
*Assistant Examiner* — Webeshet Mengesha
(74) *Attorney, Agent, or Firm* — Benjamin Keim; Newport IP, LLC

(57) ABSTRACT

Cryogenic removal of carbon dioxide from the atmosphere, or CryoDAC (Cryogenic Direct Air Capture), uses extremely low temperatures to convert atmospheric $CO_2$ into a frozen solid while other components of air such as oxygen and nitrogen remain as gases. Air from the atmosphere is passed through a recuperative heat exchanger to cool the air to a temperature slightly above the deposition point of $CO_2$. The cooled air is then passed over a deposition surface chilled to a temperature below the deposition point of $CO_2$. Carbon dioxide in the air transitions from gas to solid form upon contact with the deposition surface. The frozen $CO_2$ is collected and stored. The cold air with $CO_2$ removed is passed back through the recuperative heat exchanger to cool incoming air and is then returned to the atmosphere. The deposition surface may be cooled by a cryogenic refrigerator.

20 Claims, 3 Drawing Sheets

(56) References Cited

U.S. PATENT DOCUMENTS

| | | | | |
|---|---|---|---|---|
| 8,163,070 | B2 | 4/2012 | Hees et al. | |
| 9,073,003 | B2 | 7/2015 | Crooks et al. | |
| 9,844,748 | B2 | 12/2017 | Lourenco et al. | |
| 2002/0134544 | A1* | 9/2002 | DeVilbiss | H05K 7/206 165/291 |
| 2004/0134211 | A1* | 7/2004 | Lee | F24F 12/006 62/271 |
| 2011/0132577 | A1* | 6/2011 | Kaufman | F25J 1/0275 165/104.19 |
| 2012/0038120 | A1 | 2/2012 | Bartlett et al. | |
| 2012/0180657 | A1* | 7/2012 | Monereau | F25J 3/067 95/290 |
| 2013/0047664 | A1* | 2/2013 | DiCenzo | B01D 53/04 96/132 |
| 2013/0139543 | A1 | 6/2013 | Baxter | |
| 2016/0354722 | A1* | 12/2016 | Yamamoto | B01D 53/0454 |
| 2018/0080379 | A1* | 3/2018 | Conlon | F25J 1/0045 |
| 2020/0056795 | A1* | 2/2020 | Mishra | F24F 13/30 |
| 2020/0300559 | A1* | 9/2020 | Wang | F28F 9/24 |
| 2020/0306768 | A1* | 10/2020 | Baxter | B30B 15/34 |
| 2020/0398214 | A1* | 12/2020 | Lackner | B01D 53/08 |
| 2021/0008464 | A1* | 1/2021 | Belancik | B01D 7/00 |
| 2022/0234975 | A1* | 7/2022 | Ridley, Jr. | C01B 3/50 |

OTHER PUBLICATIONS

"Credit Suisse Sees US$500 Billion Investment in Carbon Capture Needed Over the Next Few Decades", Retrieved from: https://www.tradingview.com/news/mtnewswires.com:20211221:A2566368:0-credit-suisse-sees-US-500-billion-investment-in-carbon-capture-needed-over-the-next-few-decades/, Dec. 21, 2021, 3 Pages.

"Negative Emissions Technologies and Reliable Sequestration: A Research Agenda", In Publication of National Academies Press, Apr. 8, 2019, 511 Pages.

"Shell & Tube Heat Exchangers", Retrieved from: https://web.archive.org/web/20191210131139/http:/www.graphitehe.com/shell_tube_heat.php, Dec. 10, 2019, 3 Pages.

"Turbo-Brayton Cryogenic Systems", Retrieved from: https://web.archive.org/web/20220126184811/https:/advancedtech.airliquide.com/turbo-brayton-cryogenic-systems, Jan. 26, 2022, 8 Pages.

Rajkonwar, et al., "Numerical Study on Cryogenic Carbon Capture by Desublimation", Retrieved from: https://indico.cern.ch/event/760666/contributions/3391015/, Jul. 22, 2019, 1 Page.

Tabor, Abigail, "Testing on the Ground Before You Fly: Wind Tunnels at NASA Ames", Retrieved from: https://www.nasa.gov/ames/wind-tunnels, May 22, 2020, 5 Pages.

Watson, Frank, "Global Carbon Market Grows 20% to $272 Billion in 2020: Refinitiv", Retrieved from: https://www.spglobal.com/commodityinsights/en/market-insights/latest-news/coal/012721-global-carbon-market-grows-20-to-272-billion-in-2020-refinitiv, Jan. 27, 2021, 4 Pages.

"International Search Report and Written Opinion Issued in PCT Application No. PCT/US23/012961", Mailed Date: Jun. 2, 2023, 11 Pages.

Communication pursuant to Article 94(3) received in European Application No. 23711228.9, mailed on Jul. 3, 2025, 05 pages.

* cited by examiner

CRYOGENIC REMOVAL OF CARBON DIOXIDE FROM THE ATMOSPHERE

PRIORITY APPLICATION

This application claims the benefit of and priority to U.S. Provisional Application No. 63/325,552, filed Mar. 30, 2022, the entire contents of which are incorporated herein by reference.

BACKGROUND

Climate change caused by human emissions of greenhouse gases may pose an existential threat to many types of life and ecosystems on this planet. In addition to reducing new emissions, carbon capture of carbon dioxide ($CO_2$) already in the atmosphere is needed to avoid the worst impacts of climate change. The amount of $CO_2$ in the atmosphere in 2022 is 415 parts per million (ppm). The level is the highest in human history and is growing each year. Indications are that by 2050 humanity will need to remove up to 10 gigatons of carbon dioxide ($CO_2$) from the atmosphere annually, with that number doubling to 20 gigatons per year by 2100.

Most atmospheric $CO_2$ capture has been focused on chemical direct air capture (DAC) or natural methods (e.g., growing forests). DAC is a process of capturing $CO_2$ directly from the ambient air and generating a concentrated stream of $CO_2$ for sequestration. Carbon dioxide removal is achieved when ambient air contacts chemical media, typically an aqueous alkaline solvent or a sorbent. These chemical media are subsequently stripped of $CO_2$ through the application of energy (namely heat), resulting in a $CO_2$ stream that can undergo dehydration and compression. DAC is enormously energy and resource intensive. Current approaches are too expensive and require too much energy to be practical for removing significant amounts of $CO_2$ from the atmosphere. Natural approaches to carbon capture do not require large inputs of energy but do require natural resources (e.g., forest land) at a scale that is not practical.

Alternative techniques for efficiently removing many gigatons of $CO_2$ from the atmosphere are needed to reduce climate change. This disclosure is made with respect to these and other considerations.

SUMMARY

This disclosure provides a system and method for cryogenic $CO_2$ direct air capture also referred to as CryoDAC. With these techniques, water and $CO_2$ are frozen out of air without liquifying or freezing the major components of air and without use of solvents or sorbents to capture the $CO_2$. A fan moves the air from the atmosphere through a recuperative heat exchanger where the air is pre-cooled to a temperature just above the deposition (or anti-sublimation) temperature of atmospheric $CO_2$. The deposition temperature depends on the atmospheric pressure and the concentration of $CO_2$ and is generally between −139° C. and −148° C. The cooled air then enters a deposition chamber where the cooled air is passed over a deposition surface that is cooled to a temperature below the deposition temperature of $CO_2$. Solid $CO_2$ is deposited on the surface and the air is substantially free of $CO_2$.

The solid $CO_2$ in the form of dry ice is scraped or otherwise removed from the deposition surface and collected. The solid $CO_2$ is sequestered so that it does not return to the atmosphere. For example, the solid $CO_2$ may be moved to a sealed container and stored. Air leaving the deposition chamber has now been cooled to a temperature below the deposition temperature of $CO_2$. This cold air is returned to the recuperative heat exchanger where it is used to cool incoming air. This design reduces the energy consumption of the system because the cooling used to freeze the $CO_2$ from the air is also used to pre-cool incoming ambient temperature air. Air leaving the recuperative heat exchanger and returning to the atmosphere may have transferred substantially all of the cooling to the incoming air so that the air exits the recuperative heat exchanger no more than 2° C. below the temperature of the incoming air.

Any suitable source of low temperatures may be used to cool the deposition surface. In some implementations, a cryogenic refrigerator, such as a Brayton cryogenic system, is used to lower the temperature of the deposition surface. For example, the temperature of the deposition surface may be lowered to about −161° C.

Operation of the system may be monitored and adjusted to optimize efficiency. For example, attributes of the air moving through the system may be monitored at one or more points. Parameters such as the rate of airflow through the system and the temperature of the deposition surface may be adjusted in real time to maintain attributes of the air within predetermined thresholds. For example, the speed at which the fan moves air may be adjusted to maintain the temperature of air entering the deposition chamber at a few degrees above the deposition point of $CO_2$. Additionally, to ensure that substantially all of the $CO_2$ is frozen out of the air, the temperature of the deposition surface may be adjusted to keep the temperature of air leaving the deposition chamber below the deposition point of $CO_2$.

Features and technical benefits other than those explicitly described above will be apparent from a reading of the following Detailed Description and a review of the associated drawings. This Summary is provided to introduce a selection of concepts in a simplified form that are further described below in the Detailed Description. This Summary is not intended to identify key or essential features of the claimed subject matter, nor is it intended to be used as an aid in determining the scope of the claimed subject matter. The term "techniques," for instance, may refer to system(s), method(s), and/or operation(s) as permitted by the context described above and throughout the document.

BRIEF DESCRIPTION OF THE DRAWINGS

The Detailed Description is described with reference to the accompanying figures. In the figures, the left-most digit(s) of a reference number identifies the figure in which the reference number first appears. The same reference numbers in different figures indicate similar or identical items. References made to individual items of a plurality of items can use a reference number with a letter of a sequence of letters to refer to each individual item. Generic references to the items may use the specific reference number without the sequence of letters.

DETAILED DESCRIPTION

Figure 1:
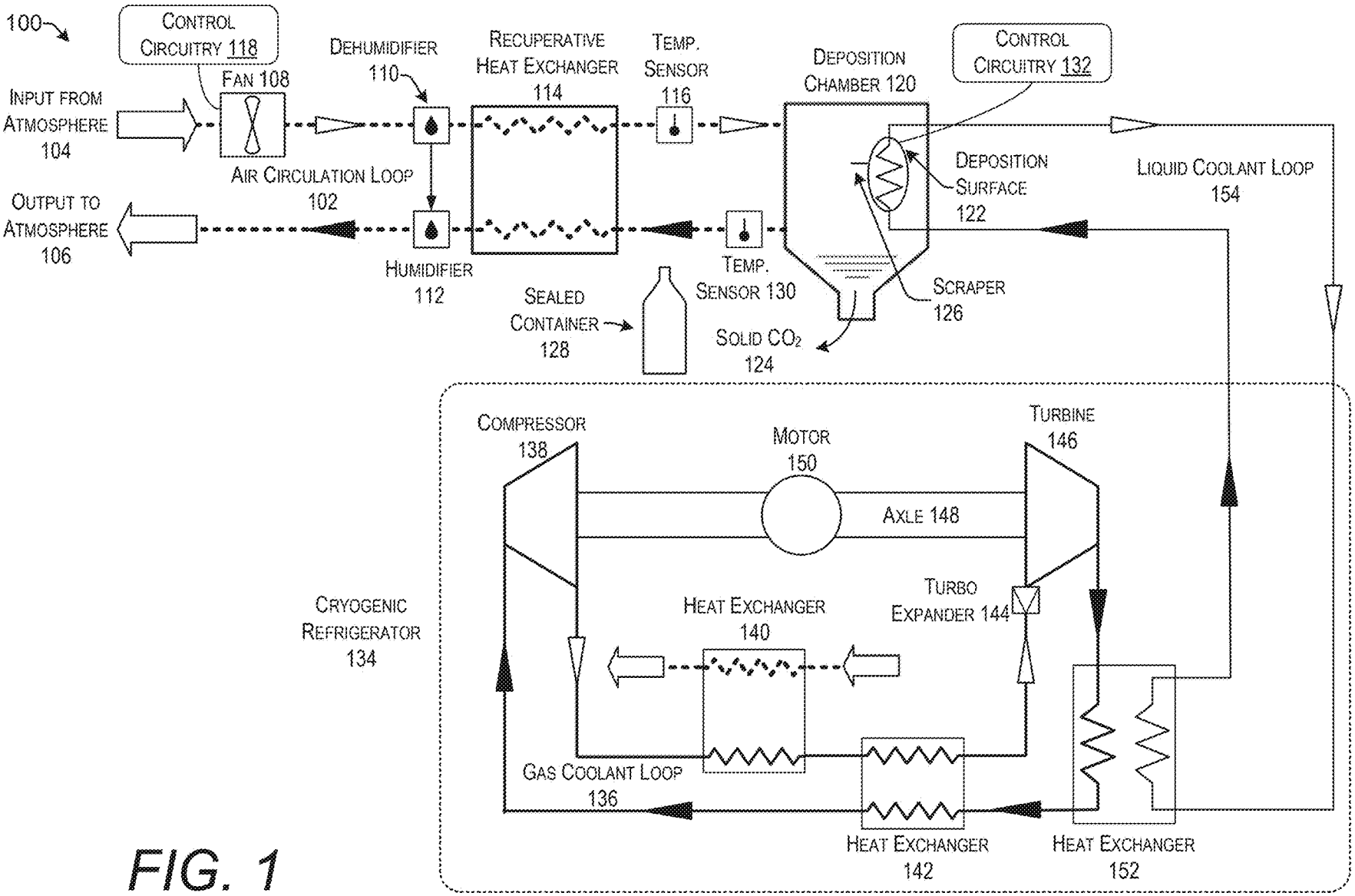
FIG. 1 is a diagram of a system for cryogenic removal of carbon dioxide from the atmosphere.

The techniques of this disclosure provide an efficient alternative to other methods of removing $CO_2$ from the atmosphere through DAC. The disclosed techniques differ from the related processes of cryogenic air separation (AS). In AS all the components of air are turned into a liquid through pressurization and cooling. Carbon dioxide and water may be removed before liquefication by passing the air through a molecular sieve bed. This is similar to the sorbent technique for DAC. The components of the liquid "air" are then separated through distillation. Liquifying all the nitrogen and oxygen in air uses a substantial amount of energy.

The inventors have recognized that $CO_2$ and water vapor both freeze or liquify at much warmer temperatures than other constituents in air. Thus, for the goal of carbon capture these are the only components of air that need to be changed from the gaseous state. Accordingly, rather than liquifying all the components of air as in AS, this technique freezes out only the $CO_2$ and water. The other components remain as gases which requires much less energy than AS. Additionally, this technique can also be performed at atmospheric pressures and does not require energy to pressurize the air.

DAC to remove $CO_2$ from the atmosphere represents a different technical problem than removal of $CO_2$ from emission sources such as smokestacks. The air in the atmosphere contains about 0.04% $CO_2$, 78% nitrogen, 21% oxygen, and <1% argon. While the amount of $CO_2$ in the atmosphere is much higher than it was prior to human use of fossil fuels, it is many tens or hundreds of times lower than the amount of $CO_2$ in smokestack emissions. Efficiently capturing $CO_2$ when it is a minor component of air is challenging. Carbon dioxide at standard atmospheric pressure does not have a liquid phase.

A pure stream of $CO_2$ from an industrial source has a deposition temperature of about −78.5° C. at 1013 millibars pressure (e.g., standard atmospheric pressure at sea level). However, deposition temperature drops as $CO_2$ concentration and atmospheric pressure decrease. For example, at current atmospheric concentrations of $CO_2$ (i.e., 420 ppm) at 1013 millibars pressure the deposition temperature is −141.9° C. If atmospheric $CO_2$ concentrations increase in the future to a concentration of 550 ppm, the deposition temperature at 1013 millibars pressure increases slightly to −142.4° C. As a further example, on the high desert plain of Antarctica with atmospheric pressure of only 675 millibars, at 420 ppm the deposition temperature of $CO_2$ is −146.1° C. As used herein, the "deposition point of atmospheric $CO_2$" refers to the temperature at which gaseous $CO_2$ in the atmosphere becomes a solid given the current atmospheric pressure and concentration of $CO_2$. As described above, this temperature depends on both the concentration of $CO_2$ in the atmosphere and the atmospheric pressure and can be readily calculated by one of ordinary skill in the art.

FIG. 1 illustrates a system 100 for cryogenic removal of $CO_2$ from the atmosphere. This system 100 may, in some implementations, remove about 1000 kg of $CO_2$ in 24 hours. The system 100 has an air circulation loop 102 shown as a bold dotted line with an input from the atmosphere 104 and an output to the atmosphere 106. Air is moved into and through the air circulation loop 102 by one or more fans 108. The air enters at standard atmospheric temperature and pressure. Given the current amount of $CO_2$ in the atmosphere, the air entering the air circulation loop 102 may have a concentration of $CO_2$ below about 500 ppm, below about 440 ppm, or below about 420 ppm.

The fan 108 may be configured as any type of fan for moving air. In some implementations, the speed of the fan 108 and the volume of the air circulation loop 102 are configured to move the air with a velocity of about 2.6 m/sec and a mass flow of about 45 kg/sec. Triangles along the air circulation loop 102 indicate the direction of air movement with open triangles corresponding to the entry pathway and closed triangles corresponding to the return pathway.

Water vapor in the air may be removed by one or more dehumidifiers 110 that reduce the moisture content of the air. Water may be removed from the air before entry to a recuperative heat exchanger 114 to reduce corrosion and damage to the recuperative heat exchanger 114 and other downstream components of the system. Early removal of the water also prevents formation of ice crystals within the recuperative heat exchanger 114 as the air is cooled below the freezing point of water. Water captured by the dehumidifier 110 may be collected and stored for later use. The water may alternatively be returned to the air before it leaves the system 100 by one or more humidifiers 112.

The air, which may have water vapor removed, is injected into one or a sequence of recuperative heat exchangers 114. The recuperative heat exchanger 114 cools the air to a temperature near the deposition temperature of $CO_2$ (e.g., −144° C.) by the time the air leaves the recuperative heat exchanger 114. The specific temperature will vary depending on atmospheric pressure and the amount of $CO_2$ in the air. Although only one is illustrated in FIG. 1, any suitable number and configuration of recuperative heat exchangers 114 may be used to pre-cool the incoming air. For example, the recuperative heat exchanger 114 may be a countercurrent flow heat exchanger. In an implementation, one or more of the recuperative heat exchangers 114 are configured as shell and tube recuperative heat exchangers. The recuperative heat exchanger 114 cools the air down to a temperature that is a few degrees (e.g., between about 5° C. above to about 1° C.) above the deposition temperature of atmospheric $CO_2$. This temperature may be between about −137° C. to about −141° C. In an implementation, a shell and tube recuperative heat exchanger may have fins inside the tubes to create additional surface area. Addition of fins may increase the efficiency of the heat exchange as much as two to four times.

The temperature of the air leaving the recuperative heat exchanger 114 may be monitored and adjusted in real time. A first temperature sensor 116 such as a thermometer is used to monitor the air temperature. The temperature may be monitored to determine if it is within a specified range such as, for example, between about −137° C. to about −141° C. If the air is too cold, sold $CO_2$ may deposit on parts of the system 100 that could impede airflow or be difficult to collect and remove. If the air is too warm, later stages of processing may be unable to freeze all of the $CO_2$ out of the air. Temperature data from the first temperature sensor 116 may be used by control circuitry 118 that is configured to adjust the speed of the fan 108 and thus the velocity of the air moving through the system 100. If the air temperature is above a threshold temperature (i.e., too warm) the fan speed may be decreased so that the air has a longer time to cool in the recuperative heat exchanger 114. If the air is below a threshold temperature (i.e., too cold) the fan speed may be increased so that the air passes through the recuperative heat exchanger 114 more quickly and cools less.

The cooled air flows into a deposition chamber 120 where the $CO_2$ is frozen out of the air. The deposition chamber 120 contains one or more depositions surfaces 122 that have been chilled to a temperature below the deposition point of atmospheric $CO_2$ but significantly above the freezing temperatures of other components of air such as nitrogen and oxygen. For example, the temperature of the deposition surface 122 may be a temperature below −141° C. such as about −145° C., about −152° C., about −155° C., about −160° C., or about −161° C. Air entering the deposition chamber 120 comes into contact with the deposition surface 122. The deposition surface 122 may be any shape of surface such as, but not limited to, a series of fins, a flat plate, or the inside of a tube.

Solid $CO_2$ 124 that forms on the deposition surface 122 can in one implementation be removed by a scraper 126. The scraper 126 may be implemented in any configuration that is configured to physically remove solid $CO_2$ 124 from a surface. For example, a flat blade or paddle may be used to scrape the surface of a flat plate. If the deposition surface 122 is a tube, the scraper 126 may be a screw conveyor that scrapes and moves solid $CO_2$ out from the inside of the tube.

Additionally or alternatively, the solid $CO_2$ 124 may be removed from the deposition surface 122 by other techniques besides use of a scraper 126. Persons of ordinary skill in the art will be able to readily adapt techniques for handling frozen water (i.e., ice and snow) to use in scraping or otherwise removing solid $CO_2$ 124 from the deposition surface 122.

For example, shaking or imparting vibrations to the deposition surface 122 such that crystals of frozen $CO_2$ fall from the deposition surface 122. The shaking or vibration may also be persistent to prevent adhesion to the deposition surface 122. The vibration may be ultrasonic vibration. The vibrations may be imparted intermittently by a simple knocker or hammer which can contact the deposition surface with sufficient force to remove macroscopic scale carbon $CO_2$ buildup.

Changes in temperature of the deposition surface 122 can also be used to remove solid $CO_2$. The temperature of the deposition surface 122 can be intermittently (e.g., from every few seconds to every few months depending on need) increased slightly above the deposition temperature of solid $CO_2$ causing the solid $CO_2$ to slide off of the deposition surface 122 without melting most of the solid $CO_2$.

The force of the air passing over the deposition surface 122 may be sufficient to prevent build up of solid $CO_2$ on the deposition surface 122. This could be due to the speed of the air, turbulence, occasional variation in velocity of the air, oscillations in the deposition surface imposed by the speed of the air, or other mechanical effects.

In some implementations, the deposition surface 122 may be constructed from or coated with a material that resists adhesion of solid $CO_2$. Thus, the solid $CO_2$ would form on the deposition surface 122 then slid off where it can be collected. Similarly, the deposition surface 122 may be composed of or coated by a material which, when subject to an electric current, tends to reduce the affinity for or even repel $CO_2$. The electric current may be generated continually or intermittently to remove solid $CO_2$ as need.

In one implementation, the varying magnetic characteristics of gases present in the air (including nitrogen, oxygen, and carbon dioxide) may be used to keep solid $CO_2$ from depositing on the deposition surface 122. For example, the system 100 may include pairs of deposition surfaces that act as opposite poles of a magnetic field, preferentially attracting oxygen molecules and reducing the rate of $CO_2$ accumulation on the deposition surfaces. Such magnetic fields could be natural (e.g., permanent magnets) or artificially induced, in the latter case persistent or intermittent.

Solid $CO_2$ 124 removed from the deposition surface 122 is collected. Initially, the solid $CO_2$ 124 may be collected as a powder, crystals, or chunks of dry ice within the deposition chamber 120. The solid $CO_2$ 124 is transferred out of the deposition chamber 120 and sequestered, stored, or shipped to another location. The solid $CO_2$ 124 may be placed in one or more sealed containers 128. There may be a sealed connection between an outlet of the deposition chamber 120 and an inlet to the sealed container 128. The sealed connection can be configured to maintain pressure and prevent release of $CO_2$ during transfer. The sealed container 128 prevents the solid $CO_2$ from returning to the atmosphere. The solid $CO_2$ may be stored in the sealed container 128 temporarily or for long term. The sealed container 128 may be any type of container configured to hold solid and gaseous $CO_2$. In some implementations, the sealed container 128 may be a tank or other type of container with a fixed volume. The fixed volume may be established by rigid walls in the container that do not change dimensions if the solid $CO_2$ sublimates to gas and increases in volume.

If the sealed container 128 is moved to an environment above the deposition temperature of $CO_2$ (e.g., above about −78.5° C.), the $CO_2$ will become a gas. Warming of the solid $CO_2$ in a sealed container 128 with a fixed volume can cause an increase in pressure as the $CO_2$ sublimates and expands. This creates a container of pressurized $CO_2$ gas. The pressurized gas may be used to do work such as generation of electricity or powering operation of the system 100. Release of the pressure will be done while maintaining containment of the $CO_2$ so that it is not released back into the atmosphere. The pressure may be used in the sequestration of the $CO_2$ such as by providing the energy to inject the $CO_2$ into a geological formation where it can be absorbed and stored.

A second temperature sensor 130 may be included in the system 100 to perform real-time measurement of the temperature of the chilled air leaving the deposition chamber 120. The chilled air should be substantially free of $CO_2$, water vapor, and any other components of air that freeze at or above the temperature of the deposition surface 122. The air leaving the deposition chamber 120 may have at least 70%, 80%, 90%, 95%, 97%, 98%, 99%, 99.5%, or 99.9% of $CO_2$ removed. The second temperature sensor 130 may be the same type of temperature sensor as the first temperature sensor 116 such as a thermometer. In some implementations, the air leaving the deposition chamber 120 is cooled to a temperature below the deposition temperature of atmospheric $CO_2$ (e.g., below about −144° C.).

Control circuitry 132 may be configured to adjust the temperature of the deposition surface 122 based on the temperature detected by the second temperature sensor 130. The control circuitry 132 adjusts the temperature of the deposition surface 122 to maintain the temperature of the air leaving the deposition chamber 120 below the deposition point of atmospheric $CO_2$. Keeping the temperature of air exiting the deposition chamber 120 below the deposition point of atmospheric $CO_2$ helps to ensure that substantially all of the $CO_2$ is frozen out of the air. Thus, the control circuitry 132 may be configured to adjust the temperature of the deposition surface 122 to maintain the temperature of the air leaving the deposition chamber below a first threshold temperature. If, however, the air leaving the deposition chamber 120 is well below the deposition point of atmospheric $CO_2$, the deposition surface 122 may be colder than necessary resulting in inefficiency and a waste of energy for unneeded cooling. Accordingly, the control circuitry 132 may also be, but is not necessarily, configured to adjust the temperature of the deposition surface 122 to maintain the temperature of the air leaving the deposition chamber 120 above a second threshold temperature.

The control circuitry 132 may adjust the temperature of the deposition surface 122 in any number of different ways. For example, the control circuitry 132 may be configured to control the temperature of a liquid coolant loop 154 of a cryogenic refrigerator 134. For example, the control circuitry 132 may be configured to control the amount of compression provided by a compressor 138 in the cryogenic refrigerator 134.

The return pathway of the chilled air from the deposition chamber 120 passes through the recuperative heat exchanger 114. This air that has been cooled by contact with the deposition surface 122 is now used to cool incoming air in the recuperative heat exchanger 114. This efficiently recaptures much of the energy used to freeze the $CO_2$ for precooling the next round of air. The recuperative heat exchanger 114 may be configured so that the air output to the atmosphere 106 is only slightly cooler than the air input from the atmosphere 104. For example, the air output to the atmosphere 106 may be no more than about 3° C., about 2° C., about 1° C., or about 0.5° C. cooler than the air input from the atmosphere 104.

The deposition surface 122 may be chilled by any technique for creating low temperatures such as cryogenic temperatures. FIG. 1 shows a configuration of the system 100 in which the deposition surface 122 is cooled by a cryogenic refrigerator 134. However, other cooling systems are also contemplated. In some implementations, the cryogenic refrigerator 134 may be implemented as a Brayton cryogenic system such as, for example, the Turbo-Brayton cryogenic system available from Air Liquide (Paris, France).

The cryogenic refrigerator 134 has a gas coolant loop 136 that carries a gas coolant (e.g., helium-neon). The gas coolant enters a compressor 138 where it is compressed and the temperature increases. The now heated gas run through a first heat exchanger 140 that uses atmospheric air at ambient temperature or water to initially cool the gas coolant. The gas coolant loop 136 next passes through a second heat exchanger 142 where the temperature is reduced further and to a turboexpander 144. Expansion of the gas coolant at the turboexpander 144 decreases the temperature of the gas coolant and drives a turbine 146.

The turbine 146 may share an axle 148 with the compressor 138. Energy of the expanding gas causes rotation of the turbine 146 and this energy is passed through the axle 148 to assist a motor 150 powering the compressor 138. Now at much lower temperature and pressure, the coolant gas passes from the turbine 146 to a third heat exchanger where it condenses a liquid coolant (e.g., methane) in a liquid coolant loop 154. Gas coolant leaving the third heat exchanger 152 passes back through the second heat exchanger 142 where the cool gas is used to precool warmer gas before entering the turboexpander 144. Any or all of the heat exchangers in the cryogenic refrigerator 134 may be implemented as countercurrent flow heat exchangers.

A temperature of the liquid coolant in the liquid coolant loop 154 is below the deposition temperature of atmospheric $CO_2$ and may be, for example, about −161° C. The temperature of the liquid coolant in the liquid coolant loop 154 may remain roughly constant. The liquid coolant loop 154 provides cooling to the deposition surface 122. For example, the liquid coolant loop 154 may be configured to pass through or directly adjacent to the deposition surface 122.

A single cryogenic refrigerator 134 may be used to provide cooling for multiple separate cryogenic $CO_2$ removal systems. For example, the liquid coolant loop 154 may pass through multiple deposition surfaces 122 (not shown) each included in a different cryogenic $CO_2$ removal system with a separate air circulation loop. Alternatively, the third heat exchanger 152 may include multiple liquid coolant loops 154 each cooling a separate cryogenic $CO_2$ removal system.

Two of the largest energy inputs required for this system 100 are the cooling of the air and removal of water vapor from the air. To improve overall efficiency and reduce needed energy input to the system 100, this cryogenic $CO_2$ removal system may be sited in locations that have cold and dry climates such as the arctic or Antarctic.

Figure 2A:
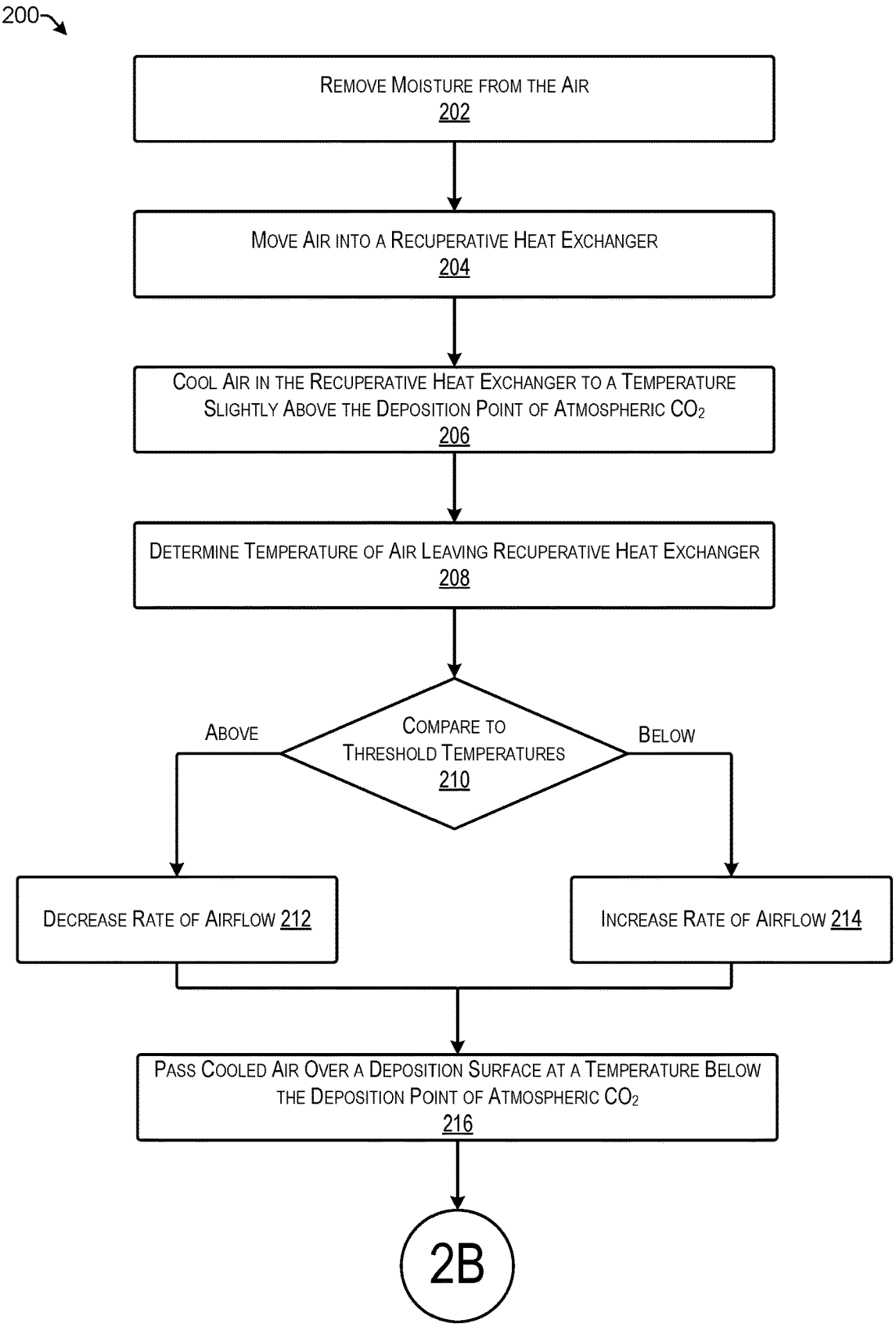
FIGS. 2A and 2B are a flow diagram showing aspects of a method for cryogenic removal of carbon dioxide from the atmosphere.
Figure 2B:
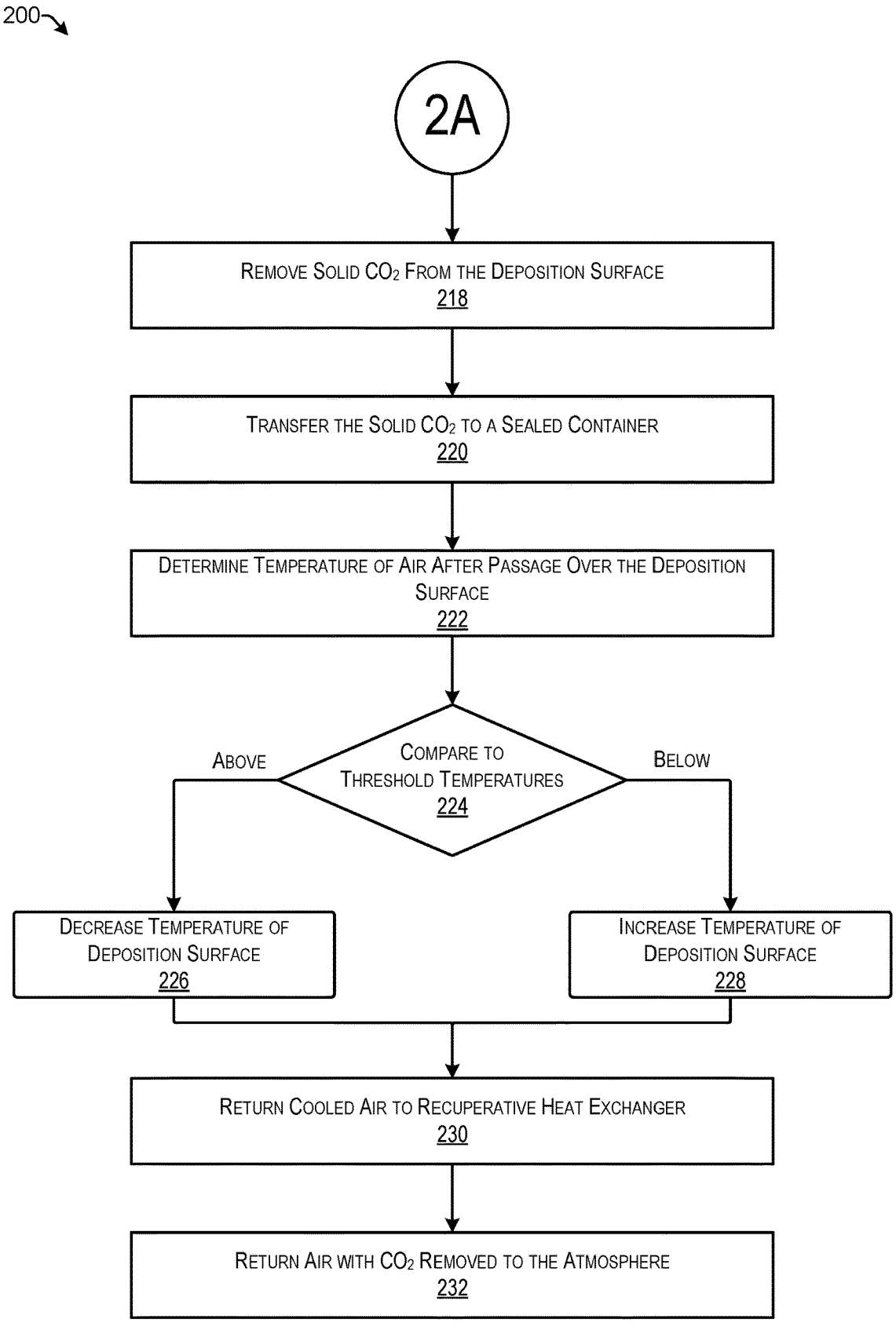

FIGS. 2A and 2B show a flow diagram of a process 200 for cryogenic removal of carbon dioxide from the atmosphere. This process 200 is implemented by the system 100 shown in FIG. 1 or a similar system.

At operation 202, moisture is removed from air entering the system from the atmosphere. The moisture may be removed by any known technique for removing water vapor from air. For example, the moisture may be removed by one or more dehumidifiers. Moisture removed from the air may be transferred back to the air before release to the atmosphere.

At operation 204, the air is moved into a recuperative heat exchanger. The air may be moved by one or more fans into the recuperative heat exchanger. The air may be moved into the recuperative heat exchanger at a velocity of about 2.6 m/sec with a mass flow of about 45 kg/sec would result in the capture of about 1000 kg of solid $CO_2$ in 24 hours. The recuperative heat exchanger may be the recuperative heat exchanger 114 shown in FIG. 1. The air may be moved at atmospheric pressure, that is without additional pressurization, into the recuperative heat exchanger.

At operation 206, the air in the recuperative heat exchanger is cooled to a first temperature slightly above the deposition point of atmospheric $CO_2$. The first temperature may be, for example, between about 5° C. above to about 1° C. above the deposition point of atmospheric $CO_2$. Depending on the air pressure and other conditions such as $CO_2$ concentration, this first temperature may be between about −137° C. to about −141° C.

At operation 208, the temperature of the cooled air leaving the recuperative heat exchanger is determined. The temperature may be determined by a temperature sensor such as the first temperature sensor 116 shown in FIG. 1 that measures the temperature of the air.

At operation 210, the temperature of the air leaving the recuperative heat exchanger is compared to one or more threshold temperatures. If the temperature is above a first threshold temperature, process 200 proceeds along the "above" path to operation 212. If, however, the temperature is below a second threshold temperature, process 200 proceeds along the "below" path to operation 214. The first threshold temperature is higher than the second threshold temperature and the first threshold temperature may be, for example, about −137° C., about −140° C., about −139° C., or about −142° C. The second threshold temperature may be, for example, about −140° C., about −139° C., or about −142° C., or about −141° C. In some implementations, the first threshold temperature and the second threshold temperature may be the same.

At operation 212, when the temperature of the air leaving the recuperative heat exchanger is above the first threshold temperature, the rate of airflow is decreased. The rate of airflow may be decreased by reducing the speed of the fan that injects air into the recuperative heat exchanger.

At operation 214, when the temperature of the air leaving the recuperative heat exchanger is below the second threshold temperature, the rate of airflow into the recuperative heat exchanger is increased. Adjusting the rate of airflow at operation 212 or 212 maintains the temperature of the air leaving the recuperative heat exchanger just above the deposition point of atmospheric $CO_2$. Both the first threshold temperature and the second threshold temperature may be predetermined or may be determined dynamically as the system is operating to reduce energy expenditure. For example, both the first threshold temperature and the second threshold temperature may be determined by linear equations or machine learning.

At operation 216, air cooled by the recuperative heat exchanger at operation 206 is passed over a deposition surface that is chilled to a temperature below the deposition point of atmospheric $CO_2$. The deposition surface may be the deposition surface 122 within the deposition chamber 120 as shown in FIG. 1. As the chilled air passes over the deposition surface, solid $CO_2$ forms on the deposition surface and is removed from the air. The temperature of the deposition surface may be, for example, below −141° C. such as about −145° C., about −152° C., about −155° C., about −160° C., or about −161° C.

At operation 218, solid $CO_2$ is removed from the deposition surface. The solid $CO_2$ may be removed by any technique for removing dry ice from a solid surface. For example, the solid $CO_2$ may be mechanically scraped from the deposition surface. A scraper such as the scraper 126 shown in FIG. 1 may be used for this purpose. Alternatively, the deposition surface may be shaken or vibrated so that solid $CO_2$ crystals fall off without direct physical contact of a scraper or similar object.

At operation 220, the solid $CO_2$ is transferred to a sealed container. The sealed container may be the sealed container 128 shown in FIG. 1. The sealed container may have a fixed volume. The solid $CO_2$ may be moved from a deposition chamber that contains the deposition surface to the container by any technique for transporting or moving dry ice or techniques used for movement of snow or water ice suitably adapted if necessary for use with dry ice. For example, the solid $CO_2$ may be scraped or pushed so that it falls into an open container. After a portion of the container is filled with solid $CO_2$, the container may be sealed so that the $CO_2$ cannot escape. The container may have a fixed volume when sealed so that sublimation of the $CO_2$ from solid to gas fills the container with pressurized $CO_2$.

At operation 222, the temperature of air after passage over the deposition surface is determined. The temperature of the air may be determined by a temperature sensor such as the second temperature sensor 130 shown in FIG. 1 that measures the temperature of the air.

At operation 224, the temperature of the air after passage over the deposition surface is compared to one or more threshold temperatures. If the temperature is above a first threshold temperature, process 200 proceeds along the "above" path to operation 226. If, however, the temperature is below a second threshold temperature, process 200 proceeds along the "below" path to operation 228. The temperature of the deposition surface is adjusted to maintain the temperature of the air that has passed over the deposition surface below the deposition point of atmospheric $CO_2$ which is the first threshold temperature. The temperature of the deposition surface may also be adjusted to maintain the temperature of the air above a second threshold temperature that is a "too cold" temperature at which energy is expended cooling the air more than necessary to remove the $CO_2$.

At operation 226, the temperature of the deposition surface is decreased in response to a determination that the temperature of the air after passage over the deposition surface is above the first threshold temperature. The first threshold temperature may be, for example, the deposition point of atmospheric $CO_2$ which may be about −144° C. under some conditions, or a colder temperature such as about −145° C., about −152° C., about −155° C., about −160° C., about −161° C., or colder. The temperature of the deposition surface may be decreased by decreasing the temperature of a coolant loop from a cryogenic refrigerator that cools the deposition surface.

At operation 228, the temperature of the deposition surface is increased in response to a determination that the temperature of the air after passage over the deposition surface is below the second threshold temperature. The second threshold temperature is lower than the first threshold temperature and may be as about −145° C., about −152° C., about −155° C., about −160° C., about −161° C., or colder. Both the first threshold temperature and the second threshold temperature may be predetermined or may be determined dynamically as the system is operating to reduce energy expenditure. For example, both the first threshold temperature and the second threshold temperature may be determined by linear equations or machine learning.

At operation 230, cooled air leaving the deposition chamber is returned to the recuperative heat exchanger. This air that is cooled by contact with the deposition surface is now used to cool incoming air in the recuperative heat exchanger.

At operation 232, air with at least some of the $CO_2$ removed is returned to the atmosphere. Most of the cooling in the air may be captured by the recuperative heat exchanger and used to cool incoming air. Thus, the air returning to the atmosphere may be no more than about 3° C., about 2° C., about 1° C., or about 0.5° C. cooler than the temperature of the air in the atmosphere. Carbon capture may also remove substantially all of the $CO_2$ from the air so that at least 70%, 80%, 90%, 95%, 97%, 98%, 99%, 99.5%, or 99.9% of the $CO_2$ is removed from the air that returns to the atmosphere. Moisture removed from the air earlier in the process by a dehumidifier may be transferred back to the air before the air is returned to the atmosphere.

Illustrative Embodiments

The following clauses described multiple possible embodiments for implementing the features described in this disclosure. The various embodiments described herein are not limiting nor is every feature from any given embodiment required to be present in another embodiment. Any two or more of the embodiments may be combined together unless context clearly indicates otherwise. As used herein in this document "or" means and/or. For example, "A or B" means A without B, B without A, or A and B. As used herein, "comprising" means including all listed features and potentially including addition of other features that are not listed. "Consisting essentially of" means including the listed features and those additional features that do not materially affect the basic and novel characteristics of the listed features. "Consisting of" means only the listed features to the exclusion of any feature not listed.

Clause 1. A system (100) for removal of atmospheric carbon dioxide ($CO_2$) comprising: a fan (108) configured to inject air from the atmosphere into the system (100) at atmospheric pressure; a recuperative heat exchanger (114) configured to receive air from the fan (108) and cool the air to a first temperature above the deposition point of atmospheric $CO_2$; a deposition chamber (120) configured to receive cooled air from the recuperative heat exchanger (114) and contact the cooled air with a deposition surface (122) chilled to a second temperature below a deposition point of atmospheric $CO_2$ to cause formation of solid $CO_2$ and removal of $CO_2$ from the air; a scraper (126) configured to remove solid $CO_2$ from deposition surface (122) and move the solid $CO_2$ as a solid out of the deposition chamber (120); and a return pathway (portion of 102) from the deposition chamber (120) that passes through the recuperative heat exchanger (114) where the cooled air cools the air injected from the atmosphere and returns the cooled air to the atmosphere with at least some of the $CO_2$ removed.

Clause 2. The system of clause 1, further comprising: a first temperature sensor configured to detect a temperature of cooled air leaving the recuperative heat exchanger and control circuitry configured to adjust a speed of the fan to maintain the temperature of the cooled air leaving the recuperative heat exchanger at the first temperature; and a second temperature sensor configured to detect a temperature of the air leaving the deposition chamber and control circuitry configured to adjust the temperature of the deposition surface to maintain the temperature of the air leaving the deposition chamber below the deposition point of atmospheric $CO_2$.

Clause 3. The system of any of clauses 1 to 2, further comprising a dehumidifier (110) configured to receive air from the fan and remove water vapor from the air.

Clause 4. The system of any of clauses 1 to 3, further comprising a cryogenic refrigerator (134) configured to cool the deposition surface (122) in the deposition chamber (120) to the second temperature.

Clause 5. The system of clause 4, wherein the cryogenic refrigerator (134) is a Brayton cryogenic system.

Clause 6. The system of any one of clauses 1 to 5, wherein the air has a concentration of $CO_2$ below about 500 ppm.

Clause 7. The system of any one of clauses 1 to 6, wherein the fan moves the air at a velocity of about 2.6 m/sec with mass flow of about 45 kg/sec and the system generates about 1000 kg of solid $CO_2$ in 24 hours.

Clause 8. The system of any one of clauses 1 to 7, wherein the scraper (126) is a screw conveyor.

Clause 9. The system of any one of clauses 1 to 8, wherein the scraper (126) is further configured to transfer the solid $CO_2$ to a sealed container (128) with a fixed volume.

Clause 10. The system of any one of clauses 1 to 9, wherein the recuperative heat exchanger (114) is a countercurrent flow heat exchanger.

Clause 11. The system of clause 10, wherein the recuperative heat exchanger (114) is a shell and tube countercurrent flow heat exchanger.

Clause 12. The system of clause 11, wherein the recuperative heat exchanger (114) includes fins on the inside of tubes in the recuperative heat exchanger configured to increase the surface area contacted by the air as it passes through the recuperative heat exchanger.

Clause 13. The system of any one of clauses 1 to 12, wherein the first temperature is between about 5° C. above to about 1° C. above the deposition point of atmospheric $CO_2$.

Clause 14. The system of any one of clauses 1 to 13, wherein the deposition point of atmospheric $CO_2$ is about −144° C. and the first temperature is about −137° C. to about −141° C.

Clause 15. The system of any one of clauses 1 to 14, wherein the second temperature is about −161° C.

Clause 16. The system of any one of clauses 1 to 15, wherein a temperature of the cooled air returning to the atmosphere is no more than 2° C. below a temperature of the air injected from the atmosphere.

Clause 17. A method for removal of atmospheric carbon dioxide ($CO_2$) comprising: moving air at atmospheric pressure into a recuperative heat exchanger (204); cooling the air in the recuperative heat exchanger to a first temperature that is above a deposition point of atmospheric $CO_2$ (206); passing the cooled air over a deposition surface chilled to a to a second temperature below the deposition point of atmospheric $CO_2$ to cause formation of solid $CO_2$ and removal of $CO_2$ from the air (216); removing the solid $CO_2$ from the deposition surface (218); returning the cooled air after removal of the $CO_2$ to the recuperative heat exchanger to cool incoming air (230); and returning air from the recuperative heat exchanger to the atmosphere with at least some of the $CO_2$ removed (232).

Clause 18. The method of clause 17, further comprising: determining a temperature of cooled air leaving the recuperative heat exchanger and adjusting a rate of airflow of the air into the recuperative heat exchanger to maintain the temperature of the cooled air at the first temperature (208); and determining a temperature of air after passage over the deposition surface and adjusting a temperature of the deposition surface to maintain the temperature of the air after passage over the deposition surface below the deposition point of atmospheric $CO_2$ (222).

Clause 19. The method of clause 18, wherein if the temperature of cooled air leaving the recuperative heat exchanger is above a first threshold temperature (210) the rate of airflow into the recuperative heat exchanger is decreased (212) and if the temperature of cooled air leaving the recuperative heat exchanger is below a second threshold temperature (210) the rate of airflow into the recuperative heat exchanger is increased (214).

Clause 20. The method of clause 18 or 19, wherein if the temperature of air after passage over the deposition surface is above a first threshold temperature (224) the temperature of the deposition surface is decreased (226) and if the temperature of air after passage over the deposition surface is below a second threshold temperature (224) the temperature of the deposition surface is increased (228).

Clause 21. The method of any one of clauses 17 to 20, further comprising removing moisture from the air prior to moving the air into the recuperative heat exchanger and transferring the moisture to the air leaving the recuperative heat exchanger prior to returning the air to the atmosphere (202).

Clause 22. The method of any one of clauses 17 to 21, further comprising transferring the solid $CO_2$ to a sealed container with a fixed volume (220).

Clause 23. The method of any one of clauses 17 to 22, wherein the air is moved into the recuperative heat exchanger at a velocity of about 2.6 m/sec with mass flow of about 45 kg/sec and the method generates about 1000 kg of solid $CO_2$ in 24 hours.

Clause 24. The method of any one of clauses 17 to 23, wherein the first temperature is between about 5° C. above to about 1° C. above the deposition point of atmospheric $CO_2$.

Clause 25. The method of any one of clauses 17 to 24, wherein the deposition point of atmospheric $CO_2$ is about −144° C. and the first temperature is about −137° C. to about −141° C.

Clause 26. The method of any one of clauses 17 to 25, wherein the second temperature is about −161° C.

Conclusion

Although the subject matter has been described in language specific to structural features and/or methodological acts, it is to be understood that the subject matter defined in the appended claims is not necessarily limited to the specific features or acts described above. Rather, the specific features and acts are disclosed as example forms of implementing the claims.

The terms "a," "an," "the" and similar referents used in the context of describing the invention are to be construed to cover both the singular and the plural unless otherwise indicated herein or clearly contradicted by context. The terms "based on," "based upon," and similar referents are to be construed as meaning "based at least in part" which includes being "based in part" and "based in whole," unless otherwise indicated or clearly contradicted by context. The terms "portion," "part," or similar referents are to be construed as meaning at least a portion or part of the whole including up to the entire noun referenced. As used herein, "approximately" or "about" or similar referents denote a range of ±10% of the stated value. For measurements of temperature, "approximately" or "about" or similar referents denote a range of ±five degrees of the stated temperature.

Certain embodiments are described herein, including the best mode known to the inventors for carrying out the invention. Of course, variations on these described embodiments will become apparent to those of ordinary skill in the art upon reading the foregoing description. Skilled artisans will know how to employ such variations as appropriate, and the embodiments disclosed herein may be practiced otherwise than specifically described. Accordingly, all modifications and equivalents of the subject matter recited in the claims appended hereto are included within the scope of this disclosure. Moreover, any combination of the above-described elements in all possible variations thereof is encompassed by the invention unless otherwise indicated herein or otherwise clearly contradicted by context.

The invention claimed is:

1. A system for removal of atmospheric carbon dioxide ($CO_2$) comprising:

a fan configured to inject air from the atmosphere into the system at atmospheric pressure;

a recuperative heat exchanger configured to receive the air from the fan and cool the air to a first temperature above a deposition point of atmospheric $CO_2$;

a first temperature sensor configured to detect a temperature of cooled air leaving the recuperative heat exchanger and first control circuitry configured to adjust a speed of the fan to maintain the temperature of the cooled air leaving the recuperative heat exchanger at the first temperature;

a deposition chamber configured to receive the cooled air from the recuperative heat exchanger and contact the cooled air with a deposition surface chilled to a second temperature below the deposition point of atmospheric $CO_2$ to cause formation of solid $CO_2$ and removal of $CO_2$ from the air;

a second temperature sensor configured to detect a temperature of the air leaving the deposition chamber and second control circuitry configured to decrease the temperature of the deposition surface responsive to determining that the temperature of the air leaving the deposition chamber is above the deposition point of atmospheric $CO_2$ and configured to increase the temperature of the deposition surface responsive to determining that the temperature of the air leaving the deposition chamber is below a threshold temperature;

a scraper configured to remove solid $CO_2$ from the deposition surface and move the solid $CO_2$ as a solid out of the deposition chamber; and a return pathway from the deposition chamber that passes through the recuperative heat exchanger where the cooled air cools the air injected from the atmosphere and returns the cooled air to the atmosphere with at least some of the $CO_2$ removed.

2. The system of claim 1, further comprising a dehumidifier configured to receive the air from the fan and remove water vapor from the air.

3. The system of claim 1, further comprising a cryogenic refrigerator configured to cool the deposition surface in the deposition chamber to the second temperature.

4. The system of claim 1, wherein the air has a concentration of $CO_2$ below about 500 ppm.

5. The system of claim 1, wherein the scraper is a screw conveyor.

6. The system of claim 1, wherein the scraper is further configured to transfer the solid $CO_2$ to a sealed container with a fixed volume.

7. The system of claim 1, wherein the recuperative heat exchanger is a shell and tube countercurrent flow heat exchanger.

8. The system of claim 7, wherein the recuperative heat exchanger includes fins on the inside of tubes in the recuperative heat exchanger configured to increase the surface area contacted by the air as it passes through the recuperative heat exchanger.

9. The system of claim 1, wherein the first temperature is between about 5° C. to 1° C. above the deposition point of atmospheric $CO_2$.

10. A method for removal of atmospheric carbon dioxide ($CO_2$) comprising:

moving air at atmospheric pressure with a fan into a recuperative heat exchanger;

cooling the air in the recuperative heat exchanger to a first temperature that is above a deposition point of atmospheric $CO_2$;

determining a temperature of cooled air leaving the recuperative heat exchanger and adjusting a rate of airflow of the air into the recuperative heat exchanger to maintain the temperature of the cooled air at the first temperature by determining at a first time that the temperature of the cooled air leaving the recuperative heat exchanger is above a first threshold temperature and in response decreasing the rate of airflow into the recuperative heat exchanger and by determining at a second time that the temperature of the cooled air leaving the recuperative heat exchanger is below a second threshold temperature and in response increasing the rate of airflow into the recuperative heat exchanger;

passing the cooled air over a deposition surface chilled to a to a second temperature below the deposition point of atmospheric $CO_2$ to cause formation of solid $CO_2$ and removal of $CO_2$ from the air, the deposition surface within a deposition chamber;

determining a temperature of air after passage over the deposition surface and adjusting a temperature of the deposition surface to maintain the temperature of air after passage over the deposition surface below the deposition point of atmospheric $CO_2$;

determining that the temperature of air after passage over the deposition surface is above a first threshold temperature and in response decreasing the temperature of the deposition surface;

determining that the temperature of air after passage over the deposition surface is below a second threshold temperature and in response increasing the temperature of the deposition surface;

removing the solid $CO_2$ from the deposition surface with a scraper;

moving, with the scraper, the solid $CO_2$ as a solid out of the deposition chamber;

returning the cooled air after removal of the solid $CO_2$ to the recuperative heat exchanger to cool incoming air; and returning air from the recuperative heat exchanger to the atmosphere with at least some of the $CO_2$ removed.

11. The method of claim 10, further comprising removing moisture from the air prior to moving the air into the recuperative heat exchanger and transferring the moisture to the air leaving the recuperative heat exchanger prior to returning the air to the atmosphere.

12. The method of claim 10, further comprising transferring the solid $CO_2$ to a sealed container with a fixed volume and sealing the container so that the $CO_2$ cannot escape.

13. The method of claim 10, wherein the first temperature is between about 5° C. to 1° C. above the deposition point of atmospheric $CO_2$.

14. A system for removal of atmospheric carbon dioxide ($CO_2$) comprising:

a cryogenic refrigerator comprising a compressor, a heat exchanger, a gas coolant loop, and a liquid coolant loop, wherein a temperature of the liquid coolant loop is controlled by an amount of compression provided by the compressor to gas within the gas coolant loop;

a fan configured to inject air from the atmosphere into the system at atmospheric pressure, wherein the air has a concentration of $CO_2$ below about 500 ppm;

a dehumidifier configured to receive the air from the fan and remove water vapor from the air;

a recuperative heat exchanger configured to receive the air from the dehumidifier and cool the air to a first temperature about 5° C. to 1° C. above a deposition point of atmospheric $CO_2$, wherein the recuperative heat exchanger is a shell and tube countercurrent flow heat exchanger that includes fins on the inside of tubes in the recuperative heat exchanger configured to increase the surface area contacted by the air as it passes through the recuperative heat exchanger;

a first temperature sensor configured to detect a temperature of cooled air leaving the recuperative heat exchanger and first control circuitry configured to adjust a speed of the fan to decrease a rate of airflow into the recuperative heat exchanger responsive to determining that the temperature of the cooled air leaving the recuperative heat exchanger is above a first threshold temperature and configured to adjust a speed of the fan to increase the rate of airflow into the recuperative heat exchanger responsive to determining that the temperature of the cooled air leaving the recuperative heat exchanger is below a second threshold temperature;

a deposition chamber configured to receive the cooled air from the recuperative heat exchanger and contact the cooled air with a deposition surface chilled, by the liquid coolant loop of the cryogenic refrigerator, to a second temperature below the deposition point of atmospheric $CO_2$ to cause formation of solid $CO_2$ and removal of $CO_2$ from the air;

a second temperature sensor configured to detect a temperature of the air leaving the deposition chamber and second control circuitry configured to decrease the temperature of the deposition surface responsive to determining that the temperature of the air leaving the deposition chamber is above the deposition point of atmospheric $CO_2$ and configured to increase the temperature of the deposition surface responsive to determining that the temperature of the air leaving the deposition chamber is below a threshold temperature, wherein the second control circuitry is configured to adjust the temperature of the deposition surface by changing the amount of pressure provided by the compressor in the cryogenic refrigerator;

a scraper configured to remove solid $CO_2$ from deposition surface and move the solid $CO_2$ as a solid out of the deposition chamber; and a return pathway from the deposition chamber that passes through the recuperative heat exchanger where the cooled air cools the air injected from the atmosphere and returns the cooled air to the atmosphere with at least some of the $CO_2$ removed.

15. The method of claim 12, further comprising moving the container to an environment above the deposition temperature of $CO_2$ so that the $CO_2$ sublimates into a gas.

16. The method of claim 15, further comprising injecting the $CO_2$ into a geological formation where it is absorbed and stored.

17. The method of claim 15, further comprising using pressure formed in the sealed container by the sublimation of the $CO_2$ to do work.

18. The system of claim 1, further comprising a humidifier configured to return moisture collected by the dehumidifier to the cooled air before the cooled air leaves the system.

19. The system of claim 1, further comprising a cryogenic refrigerator comprising a compressor, a heat exchanger, and a coolant loop, wherein a temperature of the coolant loop is controlled by an amount of compression provided by the compressor, wherein the deposition surface is chilled by the coolant loop, and wherein the second control circuitry is configured to adjust the temperature of the deposition surface by changing the amount of pressure provided by the compressor.

20. The method of claim 10, wherein adjusting the temperature of the deposition surface comprises changing an amount of pressure provided by a compressor in a cryogenic refrigerator, the cryogenic refrigerator comprising the compressor, a heat exchanger, and a coolant loop that provides cooling to the deposition surface, wherein a temperature of a coolant loop is controlled by the amount of compression provided by the compressor.

* * * * *